US006370228B1

(12) United States Patent
Mockler et al.

(10) Patent No.: US 6,370,228 B1
(45) Date of Patent: Apr. 9, 2002

(54) X-RAY FILTER AND X-RAY EXAMINATION APPARATUS USING THE SAME

(75) Inventors: Alan J. Mockler, Horley (GB); Menno W. Prins, Rosmalen; Johannes W. Weekamp, Beek en Donk, both of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/494,669

(22) Filed: Jan. 31, 2000

(30) Foreign Application Priority Data

Feb. 3, 1999 (GB) ..... 9902252

(51) Int. Cl.[7] ..... G21K 3/00
(52) U.S. Cl. ..... 378/158; 378/156; 378/157
(58) Field of Search ..... 378/16, 158, 114, 378/156, 157; 307/131

(56) References Cited

U.S. PATENT DOCUMENTS 4,404,731 A * 9/1983 Poleshuk ..... 29/571
5,751,786 A * 5/1998 Welters et al. ..... 378/156
5,952,718 A * 9/1999 Ohtsuka et al. ..... 257/737
6,118,855 A * 9/2000 Welters et al. ..... 378/158

FOREIGN PATENT DOCUMENTS

| | | | |
|---|---|---|---|
| WO | WO9613040 | 5/1996 | G21K/3/00 |
| WO | WO9703450 | 1/1997 | G21K/3/00 |
| WO | WO9705654 | 2/1997 | H01L/27/02 |
| WO | WO9852468 | 11/1998 | A61B/6/00 |

* cited by examiner

*Primary Examiner*—Robert H. Kim
*Assistant Examiner*—Courtney Thomas
(74) *Attorney, Agent, or Firm*—John Vodopia

(57) ABSTRACT

An X-ray filter comprises an array of filter elements (5) an control circuit, the control circuit comprising an array of switching devices (33) provided on a common substrate (52), a switching device (33) being provided for each filter element for switching a control signal to the respective filter element. An output terminal of each switching device is provided with an external connection portion (54) located at the respective switching device. An array of external connection portions (54) is thus provided over the array of switching devices (33). The connection portions are then bonded to a connection block of the array of filter elements. This avoids the need to use edge connections of the substrate (52), and provides a secure mechanical and electrical connection between the control circuit and the filter array.

14 Claims, 7 Drawing Sheets

X-RAY FILTER AND X-RAY EXAMINATION APPARATUS USING THE SAME

BACKGROUND OF THE INVENTION

1. Field of the Invention

This invention relates to X-ray filters, for example for use in X-ray examination apparatus, and in which the filter comprises an array of filter elements each comprising a vessel containing an X-ray absorbing liquid.

An X-ray filter of this type is described in WO 97/03450.

2. Description of Related Art

One particular problem which arises in the manufacture of an X-ray filter of this type is the feeding of signals to the filter elements. The filter setting is adjusted by changing the level of liquid for the individual filter elements, and for this purpose an individual control line is required for each filter element.

As the filter elements comprise a vessel, for example a capillary, they cannot be defined as semiconductor circuit components on a substrate. However, the control circuitry, which is arranged to provide signals to the control lines, is most conveniently arranged as an array of semiconductor switching devices on a common substrate, for example an array of thin film transistors. The problem therefore arises in forming electrical connections from the control circuit to the array of filter elements.

Citation of a reference herein, or throughout this specification, is not to construed as an admission that such reference is prior art to the Applicant's invention of the invention subsequently claimed.

SUMMARY OF THE INVENTION

According to a first aspect of the present invention, there is provided an X-ray filter comprising an array of filter elements and a control circuit, the control circuit comprising an array of switching devices provided on a common substrate, a switching device being provided for each filter element for switching a control signal to the respective filter element, an output terminal of each switching device being provided with an external connection portion located at the respective switching device, an array of external connection portions thereby being provided over the array of switching devices, and wherein the connection portions are bonded to a connection block of the array of filter elements.

The use of a connecting portion arranged at each switching device avoids the need to use edge connections from the control circuit. This may not be possible, since these edge connections may already be used for supplying control signals to the array of switching devices. For example, the switching devices may comprise thin film switching elements on a common substrate and which are supplied with control signals from integrated circuit driver chips. The edges of the control circuit substrate, for example a glass substrate carrying an array of thin film transistors, may already be used for connections to the driver chips.

The external connection portions may comprise metallic bumps formed by stud bumping, and the metal is preferably gold.

The connection block of the array of filter elements may comprise a plurality of connected parallel membranes each carrying a plurality of conductors, each conductor leading along its respective membrane to an associated filter element. Bonding of the external connection portions to the array of filter elements then connects each external connection portion with the end of an associated conductor.

Glass spacers may be provided between the membranes, which assists in matching the temperature coefficient of expansion of the connection block with that of the control circuit, which may include a glass substrate.

The filter element array and the array of switching devices are preferably arranged in rows and columns with each membrane carrying the control signals for an individual row or column of the array of filter elements. Arranging the filter elements and switching devices in corresponding arrays simplifies the connection between the two arrays. The array of switching devices may have the same pitch as the array of filter elements, to simplify further the interface of the control lines to the array of filter elements.

Each filter element preferably comprises a capillary containing an X-ray absorbing liquid, the X-ray absorptance of each filter element being adjustable by controlling the level of the liquid in the capillary using the control signal. The membranes of the connection block may then form the capillaries or else they may be interleaved with further membranes which form the capillaries, the further membranes then being provided with conducting tracks which lead to the individual capillaries.

According to a second aspect of the present invention, there is provided an X-ray examination apparatus comprising an X-ray source, an X-ray detector and a filter of the first aspect of the invention.

BRIEF DESCRIPTION OF THE PREFERRED DRAWINGS

The invention will now be described by way of example with reference to the accompanying drawings, in which.

DETAILED DESCRIPTION OF THE PREFERRED EMBODIMENT

Figure 1:
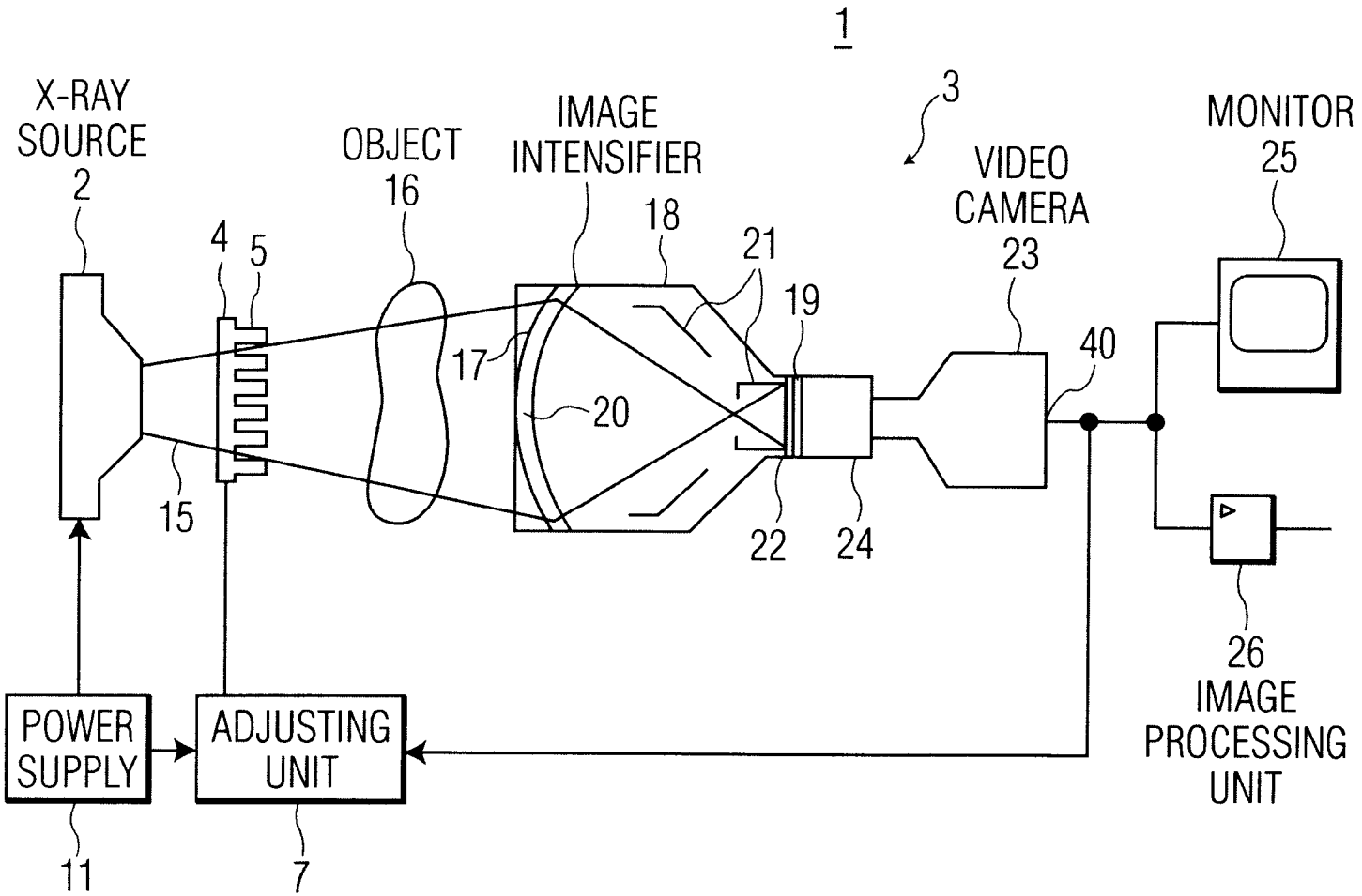
FIG. 1 shows an X-ray examination apparatus in which the X-ray filter may be constructed in accordance with the invention.

FIG. 1 shows diagrammatically an X-ray examination apparatus 1 in accordance with the invention. The X-ray source 2 emits an X-ray beam 15 for irradiating an object 16. Differences in X-ray absorption within the object 16, for example a patient to be radiologically examined, give rise to an X-ray image formed on an X-ray sensitive surface 17 of the X-ray detector 3, which is arranged opposite the X-ray source. The X-ray detector 3 of the present embodiment is formed by an image intensifier pick-up chain which includes an X-ray image intensifier 18 for converting the X-ray image into an optical image on an exit window 19 and a video camera 23 for picking up the optical image. The entrance screen 20 acts as the X-ray sensitive surface of the X-ray image intensifier which converts X-rays into an electron beam which is imaged on the exit window by means of an electron optical system 21. The incident electrons generate the optical image on a phosphor layer 22 of the exit window 19. The video camera 23 is coupled to the X-ray image intensifier 18 by way of an optical coupling 24, for example a lens system or a fibre-optical coupling. The video camera 23 extracts an electronic image signal from the optical image, which signal is applied to a monitor 25 for the display of the image information in the X-ray image. The electronic image signal may also be applied to an image processing unit 26 for further processing.

Between the X-ray source 2 and the object 16 there is arranged the X-ray filter 4 for local attenuation of the X-ray beam. The X-ray filter 4 comprises a large number of filter elements 5 in the form of capillary tubes whose X-ray absorptance can be adjusted by application of an electric voltage, referred to hereinafter as adjusting voltage, to the inner side of the capillary tubes by means of the adjusting unit 7. The adhesion of the X-ray absorbing liquid to the inner side of the capillary tubes is adjusted by means of this electric voltage. One end of the capillary tubes communicates with a reservoir for an X-ray absorbing liquid. The capillary tubes are filled with a given quantity of X-ray absorbing liquid as a function of the electric voltage applied to the individual tubes. Because the capillary tubes extend approximately parallel to the X-ray beam, the X-ray absorptance of the individual capillary tubes is dependent on the relative quantity of X-ray absorbing liquid in such a capillary tube.

The electric adjusting voltage applied to the individual filter elements is adjusted by means of the adjusting unit 7, for example on the basis of brightness values in the X-ray image and/or the setting of the X-ray source 2. For this purpose, the adjusting unit 7 is coupled to the output terminal 40 of the video camera and to the power supply 11 of the X-ray source 2. The construction of an X-ray filter 4 of this kind and the composition of the X-ray absorbing liquid are described in detail in International Patent Application WO 96/13040.

Figure 2:
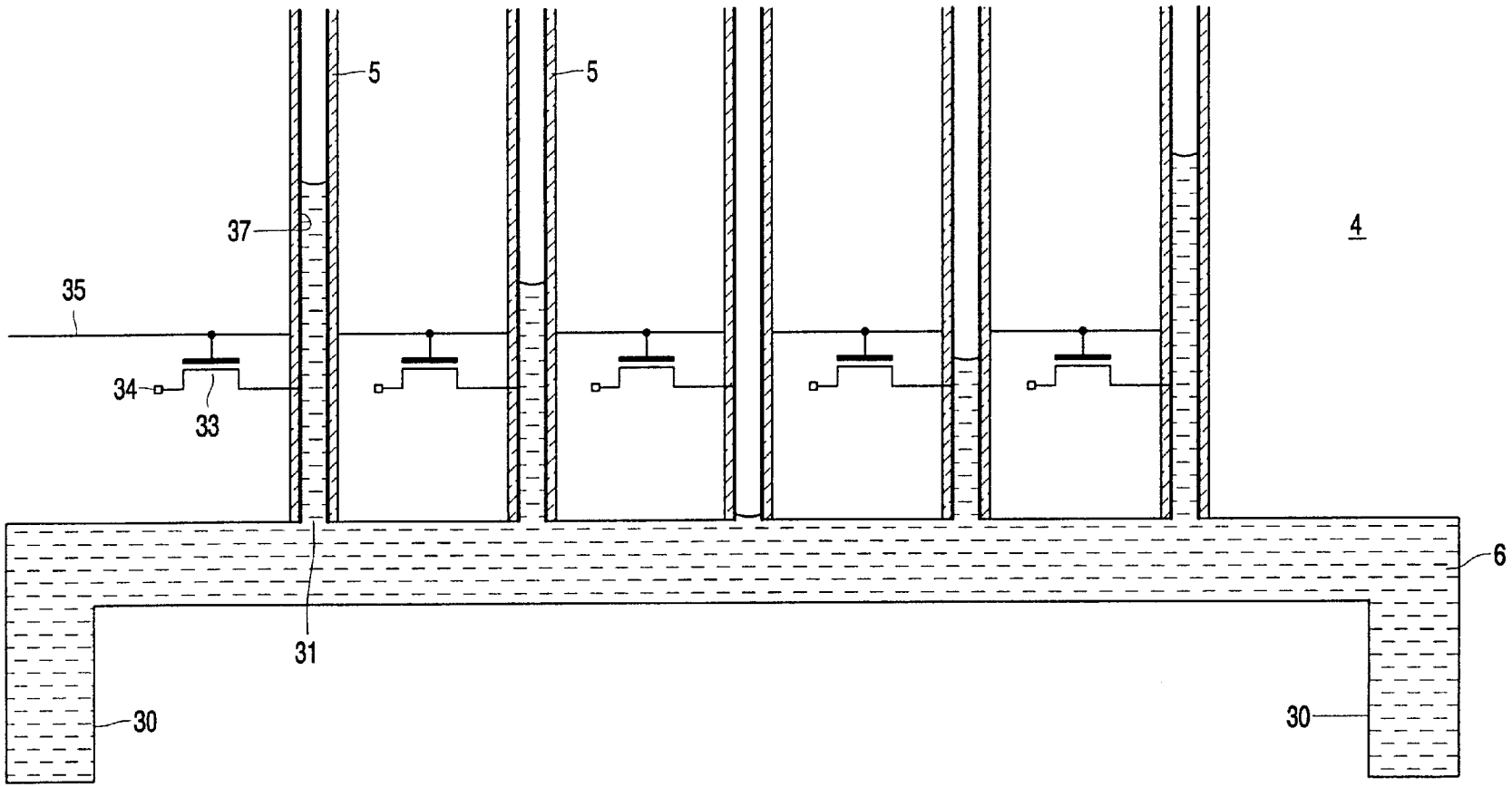
FIG. 2 shows in greater detail the filter elements of the X-ray filter used in the examination apparatus of FIG. 1.

FIG. 2 is a side elevation of an X-ray filter 4 of the X-ray examination apparatus of FIG. 1. The Figure shows seven capillary tubes by way of example, but a practical embodiment of an X-ray filter 4 of an X-ray examination apparatus in accordance with the invention may comprise a large number of capillary tubes, for example 40,000 tubes in a 200×200 matrix arrangement. Each of the capillary tubes 5 communicates with the X-ray absorbing liquid 6 at one end 31. The inner side of the capillary tubes is covered by an electrically conductive layer 37, for example of gold, platinum or aluminium, which layer 37 is coupled to a voltage line 34 via a switching element 33.

For application of the electric adjusting voltage to the electrically conductive layer 37 of a capillary tube, the relevant switching element 33 is closed while the voltage line 34 is supplied with the desired electric adjusting voltage. The switching elements are driven by a control line 35. When brief voltage pulses having a length of a few tens of microseconds are used, adjusting voltages in a range of from 0 V to 400 V can be used. In this voltage range, switches in the form of α-Si thin-film transistors can be used. Preferably, an adjusting voltage in the range of from 0 V to 100 V is used. Because the voltage pulses are so brief, the application of the adjusting voltage does not cause any, or hardly any, electrolysis of the X-ray absorbing salt solution used as the X-ray absorbing liquid. The salt solution may, for example, comprise a Lead salt or Caesium Chloride salt solution.

The X-ray absorptance of the individual capillary tubes can be controlled on the basis of the level of the electric adjusting voltage applied to the capillary tubes.

On the electrically conductive layer there is preferably provided a dielectric layer of a thickness sufficient to ensure that the electric capacitance of the capillary tubes remains low enough to enable fast response to the application of the electric voltage. However, the shorter the switch on time, the more significant becomes the electrical response time of the capillaries. A coating layer having suitable hydrophobic properties may also be provided on the dielectric layer.

Figure 3:
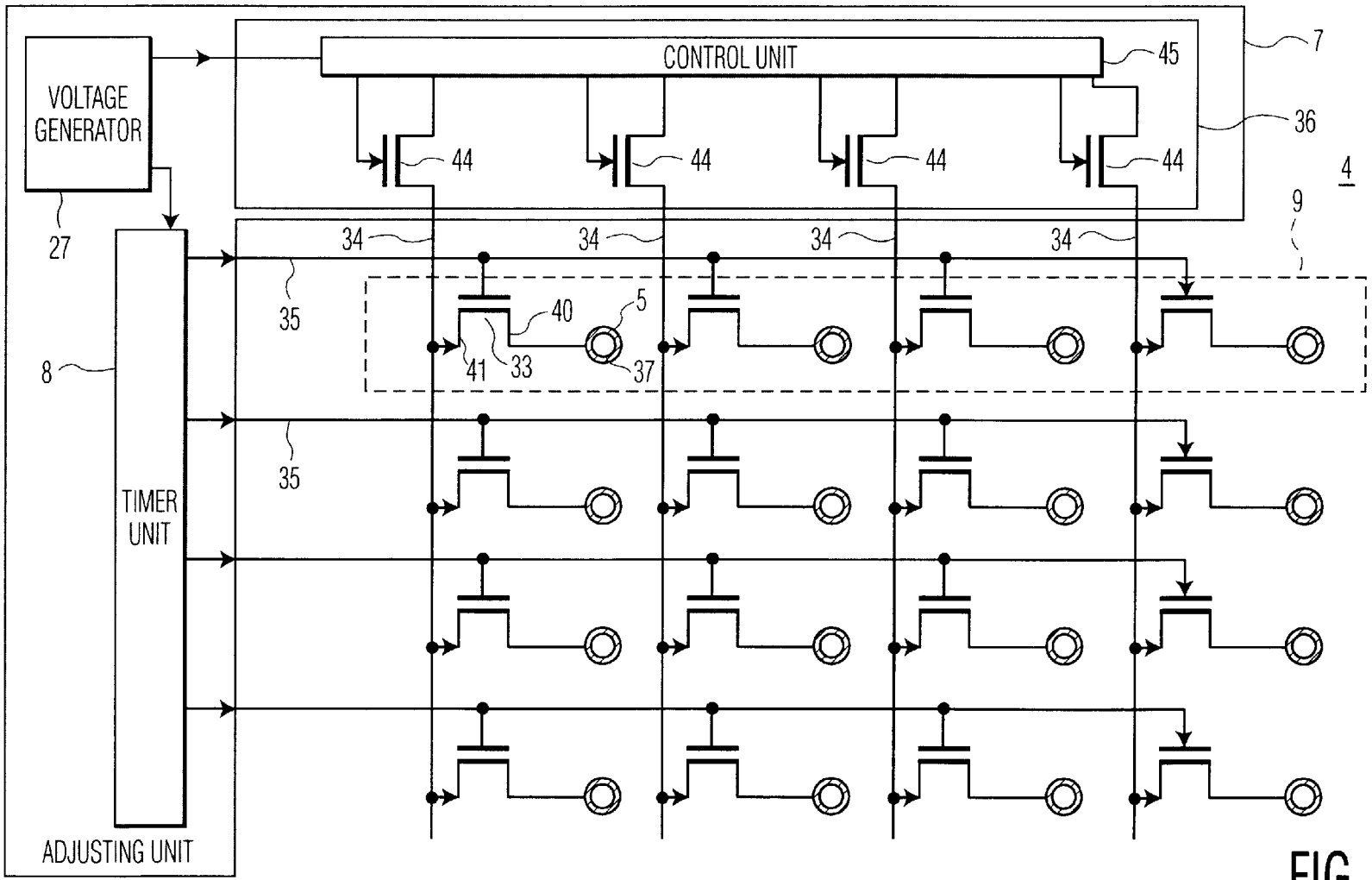
FIG. 3 shows the control circuitry used to control the filter elements shown in FIG. 2.

FIG. 3 is a plan view of an X-ray filter 4 of the X-ray examination apparatus shown in FIG. 1. An X-ray filter 4 comprising 16 capillary tubes in a 4×4 matrix arrangement is shown by way of example. However, in practice the X-ray filter 4 may comprise a much larger number of capillary tubes, for example 200×200 tubes. Each of the capillary tubes is coupled, by way of the electrically conductive layer 37, to the drain contact 40 of a field effect transistor 33 which acts as a switching device and whose source contact 41 is coupled to a voltage line which supplies the adjust voltage.

The transistors 33 together define an array of switching devices on a common substrate, for example manufactured using thin film technology. However, the capillaries 5 can not be formed on this substrate and are therefore formed as a separate array of filter elements. The invention is concerned with the connection between these two arrays.

The array of transistors is coupled using edge connectors to the adjusting unit 7, which may comprise integrated circuit driver chips, and which therefore cannot be formed on the same substrate as the array of transistors 33.

For each row 9 of capillary tubes there is provided a control line 35 which is coupled to the gate contacts of the field effect transistors in the relevant row in order to control the field effect transistors in this row. The control line 35 of the relevant row is energized by an electric control voltage pulse, in order to enable an adjusting voltage to be applied to the electrically conductive inner side of the capillary tubes in the row. The field effect transistors in the relevant row are electrically turned on during the control voltage pulse.

The control signals are provided by the adjusting unit 7, which comprises a voltage generator 27 for applying an electric voltage to the timer unit 8 which applies the control voltage pulses having the desired duration to the individual control lines of the rows of capillary tubes. While the relevant field effect transistors are turned on, i.e. the switching elements are closed, the electric adjusting voltage of the relevant control lines 34 is applied to the capillary tubes. The level of the adjusting voltage applied to individual capillary tubes in a row can be differentiated by application of different electric adjusting voltages to the respective voltage lines 34 of individual columns. To this end, the adjusting unit 7 comprises a column driver 36 which controls the application of the electric adjusting voltage generated by the voltage generator 27 to the individual voltage lines. Each of the voltage lines 34 is coupled to a respective switching element, for example a transistor 44. When the transistor 44 of the voltage line 34 is turned on by energizing the gate contact of the relevant transistor by means of a gate voltage, the adjusting voltage is applied to the voltage line. The gate contacts of the transistors 44 are coupled, via a control unit 45, to the voltage generator 27 which supplies the gate voltage. The adjusting voltages are also supplied by the control unit 45.

Figure 4:
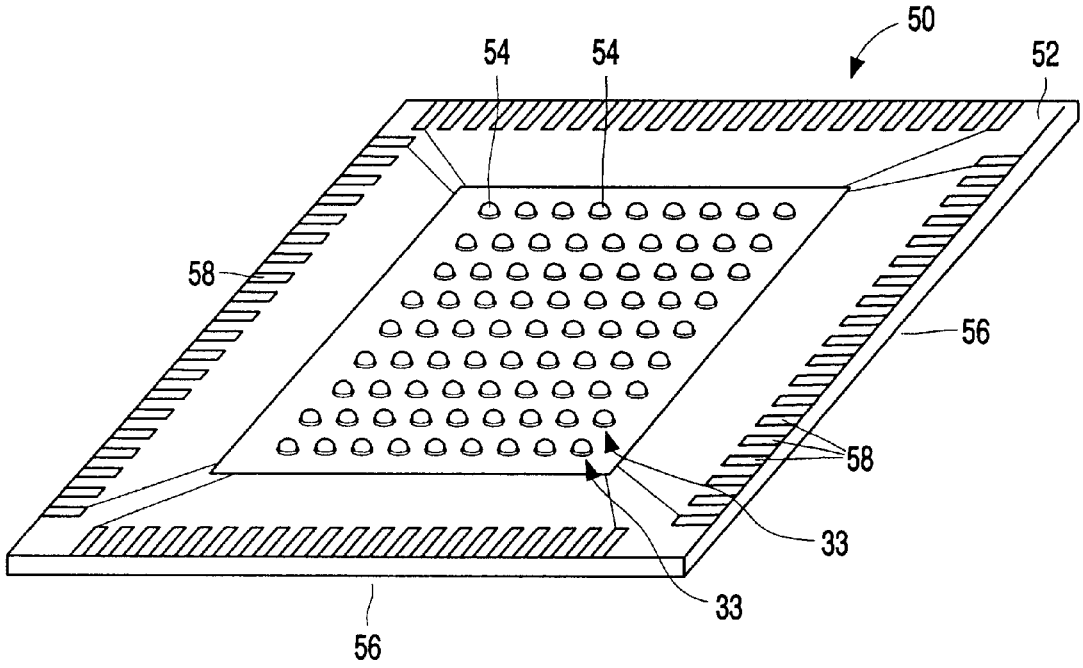
FIG. 4 shows an array of switching elements for use in the X-ray filter of the invention.

FIG. 4 shows the array 50 of switching devices, for example thin film transistors. The array is provided on a glass substrate 52, and each thin film transistor on the substrate is provided with an external connection portion 54 which is in electrical contact with the drain 40 of the associated thin film transistor 33 (shown in FIG. 3). The connecting portions 54 thereby define an array which overlies the array of thin film transistors 33. The edges 56 of the substrate 52 are provided with edge connections 58 which fan out from the transistor array. The array 50 of transistors 33 is arranged in rows and columns, and a small number of rows and columns are represented in FIG. 4 for the purposes of clarity.

Each connection portion 54 is arranged as a metal node or bump over the drain pad of each of the thin film transistors 33. These nodes may be formed using a wire bonding machine which ultrasonically bonds a wire ball bond onto the drain pad, for example a gold wire. The wire is then broken off above the ball bond, to form a gold bump over the drain pad of each transistor. All of these bumps are then planarized to give a flat-topped structure. Additional height may be applied to these external connection portions by bonding additional bumps onto the top of the first layer. The array of external connection portions provide an external interface to the array 50 which does not require the use of conducting tracks around the edges of the substrate 52.

The use of a gold wire bond is preferred as a result of the resistance of gold to oxidation. However, an aluminium wire bond may be used, preferably with the wire bonding taking place in an inert (e.g. nitrogen) local atmosphere. It may also be possible to use a solderable material, for example by depositing a low melting point solder on to the drain pads of the TFT array. This could be reflowed to form solder bumps, with a subsequent reflow process giving rise to the conductive mechanical contact between the TFT array and the capillary array.

Figure 5:
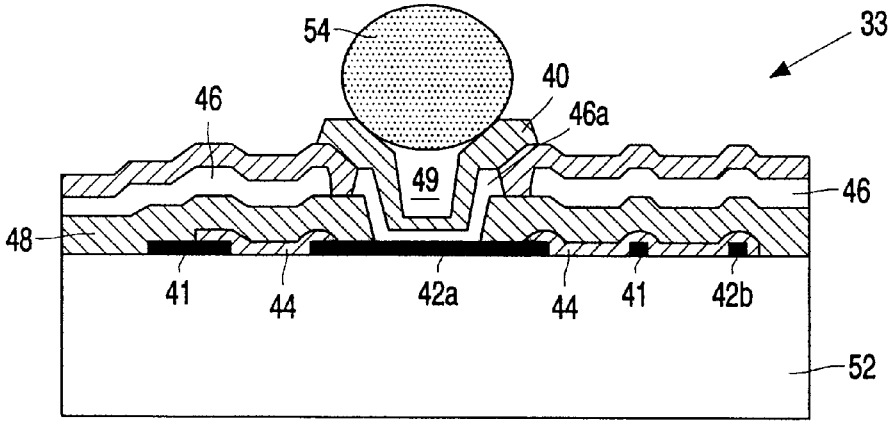
FIG. 5 shows a cross section of the array of FIG. 4.

FIG. 5 shows a cross section through one of the thin film transistors 33. Transistor 33 comprises a top-gate TFT having lower source 41 and drain 42 patterns. The transistor body 44 spans the gap between the source and drain 41, 42 and preferably comprises an amorphous silicon semiconductor layer. In the example shown in FIG. 5, the source 41 and drain 42 comprise interlocking spiral portions, which enables a TFT to be formed with a very high width to length ratio of the gate. Thus, in the example of FIG. 5, the drain comprises a central drain pad 42*a*, from which a spiralling limb 42*b* extends. The source 41 comprises an interleaved spiral pattern.

A gate insulator layer 48, for example silicon nitride, overlies the transistor body 44 and a gate contact layer 46 is provided over the gate insulator layer 48 to define the top-gate structure. A well 49 is provided in the gate insulator layer 48 over the drain pad 42*a* to enable an external contact to be made with the drain pad 42*a*. The well 49 is metallized with a region 46*a* of the gate conductor layer, and a further drain contact 40 is provided in the well 49 to which the external connection portion 54 may be bonded.

Figure 6:
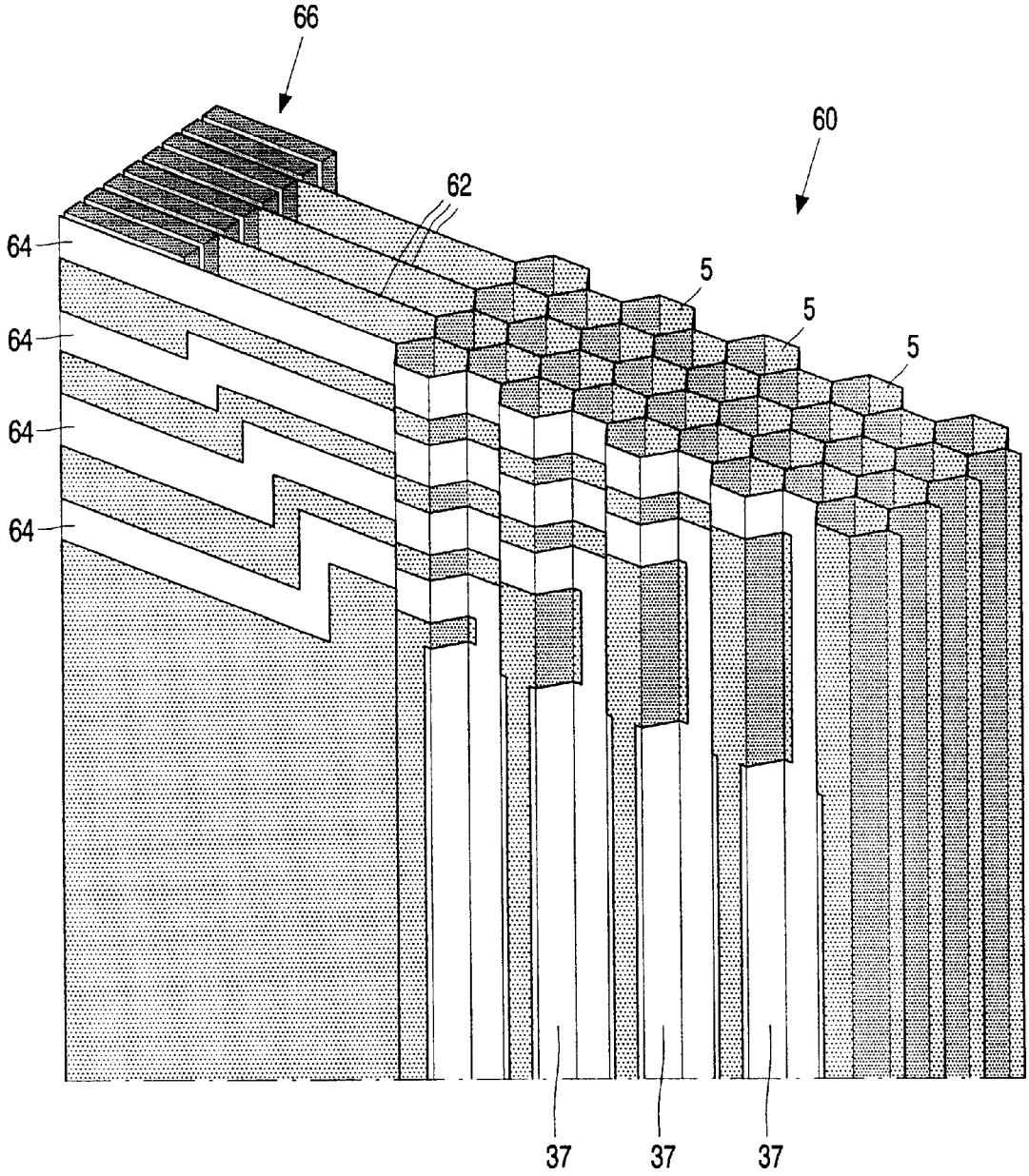
FIG. 6 shows one example of an array of filter elements for use in the X-ray filter of the invention.

FIG. 6 shows one example of the array of filter elements for use in the filter of the invention. The capillary tubes 5 are arranged in a honeycomb structure 60 which defines a network of the capillaries. The honeycomb network 60 is formed from a series of parallel membranes 62. Preferably, each membrane 62 includes two layers, and the honeycomb network is formed by selectively separating the two layers which form each membrane 62 to define the honeycomb configuration. Each membrane 62 is effectively associated with a row of capillaries 5, and conducting lines 64 are provided on the surface of the membranes 62 and which lead to individual capillaries 5 and which then form the electrically conductive layer 37 on the inner surface of each capillary. In FIG. 5, conducting lines 64 provided on one face of one membrane are shown and which define the conductive layers 37 for three sides of the hexagons of a partial row of capillaries. Each capillary has two conductive layers 37 which together provide coverage on all six faces of the internal surface of the capillaries. Thus, two conducting lines are associated with each capillary, and these terminate at an end block 66.

For the example shown in FIG. 6, it is necessary, at least for some of the capillaries, for the two conducting lines to be provided on separate membranes 62, so that two contacts are required to address those capillaries. Conducting lines may be provided on opposite sides of the membranes 62, and even between the two layers of the individual membranes, to enable all the required conductive layers 37 to be provided.

Figure 7:
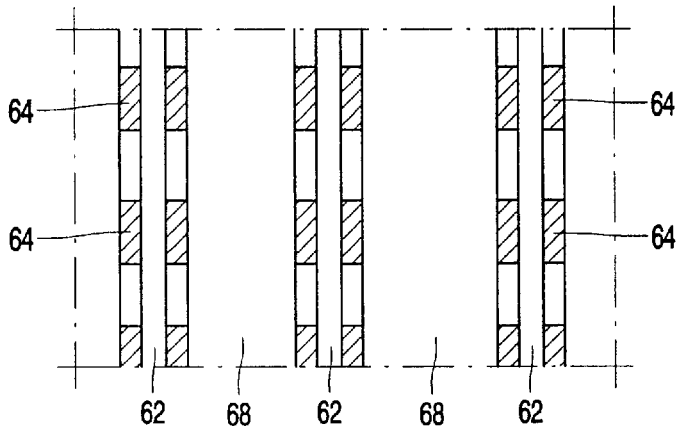
FIG. 7 shows the end face of the connection block of the array of filter elements of FIG. 5.

The membranes 62 may comprise flexible foils, for example PETP (polyethylene terephthalate) plastics foils, which provide some flexibility to the overall structure. The end block 66 is defined by heat sealing the ends of the foils to provide a rigid connection interface. The end surface of this block is metallographically ground and polished to reveal an array of aluminium track cross sections, for example as shown in FIG. 7. In the schematic example shown, each membrane 62 is provided with tracks 64 only on opposite sides of the membrane 62. A heat sealing member 68 is provided between the membranes 62 in order to form the end block 66. The member 68 may comprise extra blank membranes 62 inserted into the gaps.

A metal deposition layer may be provided over the end faces of the aluminium control lines 64 in order to provide a larger uniform metal bond pad over each individual track in the end block 66. This deposition may be performed by a mask to provide discrete bond pads, or may be performed by deposition over the entire face of the end block followed by laser ablation patterning. To ensure good electrical contact, it may be necessary to selectively etch back the foil material of the end block to expose more of the underlying aluminium tracks. This can be achieved either by chemical etching or by gas plasma etching, followed by aluminium oxide removal.

Figure 8:
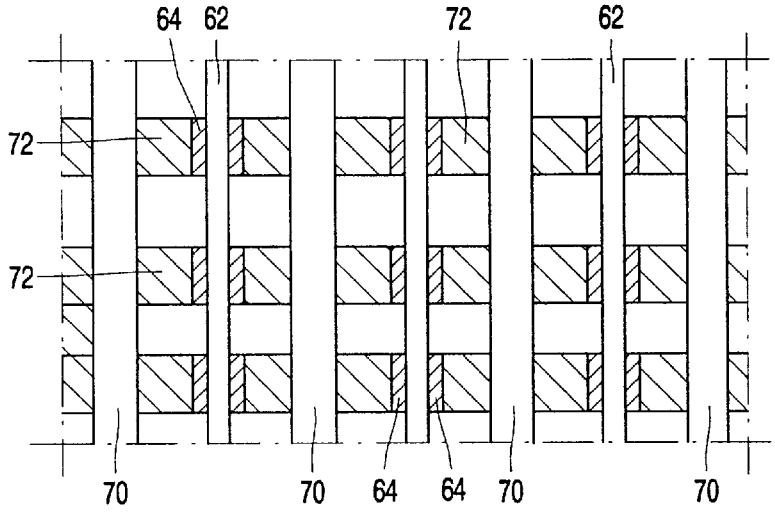
FIG. 8 shows the end face of a first alternative arrangement of the connection block of the array of filter elements.

Instead of heat sealing the foils into a rigid end block, the loose foils may be interleaved with thin glass layers 70 as shown in FIG. 8, or fibre reinforced epoxy polyimide. These glass layers are patterned with corresponding tracks 72 to those on the foils, but significantly thicker. The glass plates are then stacked face to face with the tracks on the foil surfaces, as shown in FIG. 8. The whole foil-glass assembly is then clamped into one block consisting of a number of foil-glass couples, where each foil and glass plate contain a number of tracks. The end of this clamped assembly is then metallographically ground and polished. The cross sections of the tracks on the glass are then patterned with bond pads as explained with reference to FIG. 7.

Figure 9:
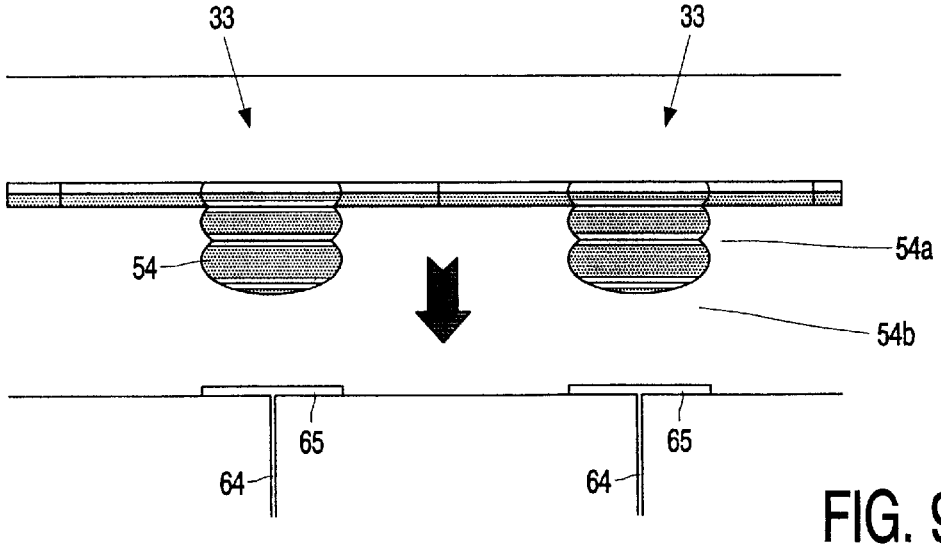
FIG. 9 shows the connection between the array of switching devices and array of filter elements.

FIG. 9 illustrates the manner in which the prepared end block of the array of filter elements is joined to the array of external connection portions 54 (the nodes) of the control circuit array 50.

The array 50 of transistors 33 is inverted and the nodes 54 are dipped into an isotropic conductive adhesive. The control circuit array is then aligned and the adhesive-coated nodes are bonded to the array of bond pads on the end block 66 of the array of filter elements. The gap between the surface of the control circuit array and the surface of the end block can be filled with a reinforcing epoxy underfill material, to provide additional mechanical and environmental protection.

Instead of an isotropic conductive adhesive, an isotropic conducting film may be laid between the two surfaces to be bonded, with pressure being applied under temperature causing reflow and curing of the film. The film comprises a dispersion of conductive particles suspended in a plastic adhesive matrix. The conductive particles provide the electrical connection between the TFT array and the capillary end block at the positions where localised pressure has been applied, namely at the gold bumps.

This arrangement provides electrical and mechanical connection between the array of transistors of the control circuit and the array of filter elements.

The transistor array may be defined so that the spacing between transistors corresponds to the spacing between the contact pads in the end block of the array of filter elements. Thus, as shown in FIG. 9, each external connection portion 54 is aligned with a contact pad 65 formed over the end of a control line 64. Matching the spacing between transistors 33 in the control circuit array and the spacing between membrane 62 emerging from the capillary array avoids the need for complicated reshaping of the membranes 62 from the capillary array. The transistor array 50 will therefore have dimensions corresponding to the part of the end block 66 carrying the control lines 64.

The transistor array 50 may be segmented into a discrete number of sub-arrays, sharing the glass substrate 52. This may be desirable to enable the end block 66 to be divided into the same discrete number of end block portions. The reason for adopting this approach is that the effective thermal cycle strain of the interface between the end block and the transistor array is proportional to the diagonal length of the end block. Therefore, dividing the end block into a number of portions results in the interface suffering less cyclic strain than for the single connection described above.

The thermal strain of the interface between the two arrays may also be reduced by attempting to match the temperature coefficients of expansion of the two arrays. The glass inserts 70 described with reference to FIG. 8 assist in this respect.

In the example of the array of filter elements shown in FIG. 6, the membranes 62 which form the end block 66 also define the capillaries 5 themselves. However, it is alternatively possible for the membrane 62 of the end block 66 to be interleaved with further membranes 63 which define the capillary array. The membranes of the end block may still comprise flexible foils, or they may comprise alternative structures.

Figure 10:
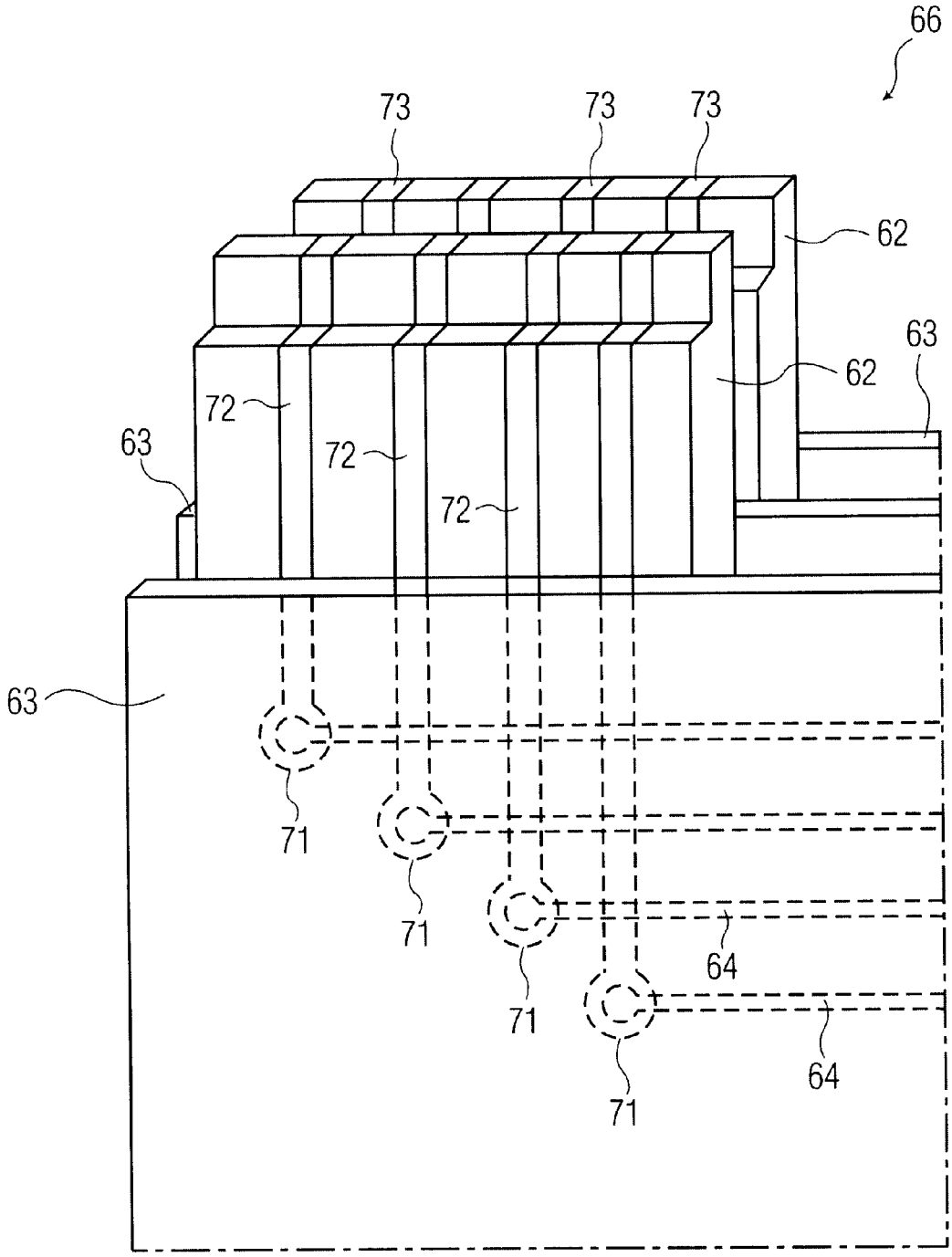
FIG. 10 shows a second alternative arrangement of the connection block of the array of filter elements.

For example, in the arrangement shown schematically in FIG. 10, the membranes 62 comprise thin metallized glass plates. The plates are patterned with metallic contact pads 71. The glass plates are inserted into the open slots at the side of the array of filter elements, with their contact pads aligned with contact pads from the control line 64 leading to the individual capillaries. Each membrane 62 has tracks on opposite sides but which are connected to the same contact pad 73 on the top surface of the glass plate. When all the plates are in place and aligned, the whole assembly is clamped to be held in place.

The contact pads 73 form a regular array of pads of the same size and pitch as the gold bumps on the transistor array. The transistor array is then bonded on top of the clamped glass plate assembly in the same manner as described previously. Since each glass sheet 62 bridges the gap between an associated pair of the additional membranes 63, it is possible to provide an arrangement in which only an individual contact pad 73 is required for each capillary.

In this arrangement the end block and the transistor array are predominantly glass. Consequently, the coefficient of thermal expansion of the two surfaces is almost identical. Resultant thermal cycle strain experienced by the interconnections between the two surfaces will be of a very low magnitude.

Although a wirebonding or soldering technique has been described for forming the external connection portions, other techniques may be employed, provided a contact is made available at the location of the switching devices. The switching device need not be transistors, arrays of other switching devices may equally be appropriate.

All references cited herein, as well as the priority document Great Britain Patent Application 9902252.7 filed Feb. 3, 1999, are incorporated herein by reference in their entirety and for all purposes to the same extent as if each individual publication or patent or patent application was specifically and individually indicated to be incorporated by reference in its entirety for all purposes.

What is claimed is:

1. An X-ray filter comprising an array of filter elements and a control circuit, the control circuit comprising an array of switching devices provided on a common substrate, a switching device being provided for each filter element for switching a control signal to the respective filter element, an output terminal of each switching device being provided with an external connection portion located at the respective switching device, an array of external connection portions thereby being provided over the array of switching devices, and wherein the connection portions are bonded to a connection block of the array of filter elements.

2. A filter as claimed in claim 1, wherein the external connection portions comprise metallic bumps formed by stud bumping.

3. A filter as claimed in claim 2, wherein the metal is gold.

4. A filter as claimed in claim 1, wherein the connection block comprises a plurality of connected parallel membranes each carrying a plurality of conductors, each conductor leading along its respective membrane to an associated filter element.

5. A filter as claimed in claim 4, wherein glass spacers are provided between the membranes.

6. A filter as claimed in claim 4, wherein the array of filter elements and the array of switching devices are arranged in rows and columns and wherein each membrane is for carrying the control signals for an individual row or column of the array of filter elements.

7. A filter as claimed in claim 6, wherein the array of switching devices has the same pitch as the array of filter elements.

8. A filter as claimed in claim 5, wherein each filter element comprises a capillary containing an X-ray absorbing liquid, the X-ray absorptance of each filter element being adjustable by controlling the level of the liquid in the capillary using the control signal.

9. A filter as claimed in claim 8, wherein the connection block membranes form the capillaries.

10. A filter as claimed in claim 8, wherein the connection block membranes are interleaved with further membranes which form the capillaries, the further membranes being provided with conducting tracks which lead to the individual capillaries.

11. A filter as claimed in claim 10, wherein the connection block membranes comprise flexible foils.

12. A filter as claimed in claim 10, wherein the connection block membranes comprise glass sheets.

13. A filter as claimed in claim 1, wherein the switching devices comprise thin film transistors.

14. An X-ray examination apparatus comprising an X-ray source, an X-ray detector and a filter as claimed in claim 1, arranged between the source and the detector.

* * * * *